US006158634A

United States Patent [19]

Kelroy

[11] Patent Number: 6,158,634

[45] Date of Patent: Dec. 12, 2000

[54] CLOTHES HANGER DEVICE

[76] Inventor: Anna H. Kelroy, 7551 Larwinn Ct., Rockford, Ill. 61107

[21] Appl. No.: 09/499,821

[22] Filed: Feb. 8, 2000

[51] Int. Cl.[7] ..... A47D 25/42

[52] U.S. Cl. ..... 223/89; 223/94; 223/95

[58] Field of Search ..... 223/85, 89, 90, 223/94, 95

[56] References Cited

U.S. PATENT DOCUMENTS

| | | | |
|---|---|---|---|
| 364,803 | 6/1887 | Christian | 233/94 |
| 686,673 | 2/1901 | Brooks | 223/94 |
| 1,207,338 | 12/1916 | Stone | 223/94 |
| 3,799,412 | 3/1974 | Ahlgren | 223/94 |
| 5,397,038 | 3/1995 | Hunt | 23/95 |

*Primary Examiner*—Bibhu Mohanty
*Attorney, Agent, or Firm*—David J. Archer

[57] ABSTRACT

A clothes hanger device is disclosed for hanging clothes from a support rail. The device includes a hook having a base, the hook removably cooperating with the support rail for supporting the device from the support rail. A frame is suspended from the base of the hook, the frame having a first and a second end. The first end of the frame defines a first hole and the second end of the frame defines a second hole. The arrangement is such that the base of the hook rotatably extends through the frame between the ends thereof A first arm has a first and a second extremity, the first arm slidingly extending through the first and second holes. The second extremity defines a stop for limiting travel of the first arm relative to the frame. A biasing device is anchored to the first arm for biasing the first arm through the first and second holes. A second arm has a first and a second side, the second arm slidingly extending through third and fourth holes defined by the frame. The first side defines a further stop for limiting travel of the second arm relative to the frame. A further biasing device is anchored to the second arm for biasing the second arm through the third and fourth holes so that the arms are biased relative to the frame. The arrangement is such that the first extremity of the first arm and the second side of the second arm engage the clothes for hanging the clothes relative to the support rail.

9 Claims, 5 Drawing Sheets

Fig. 4.
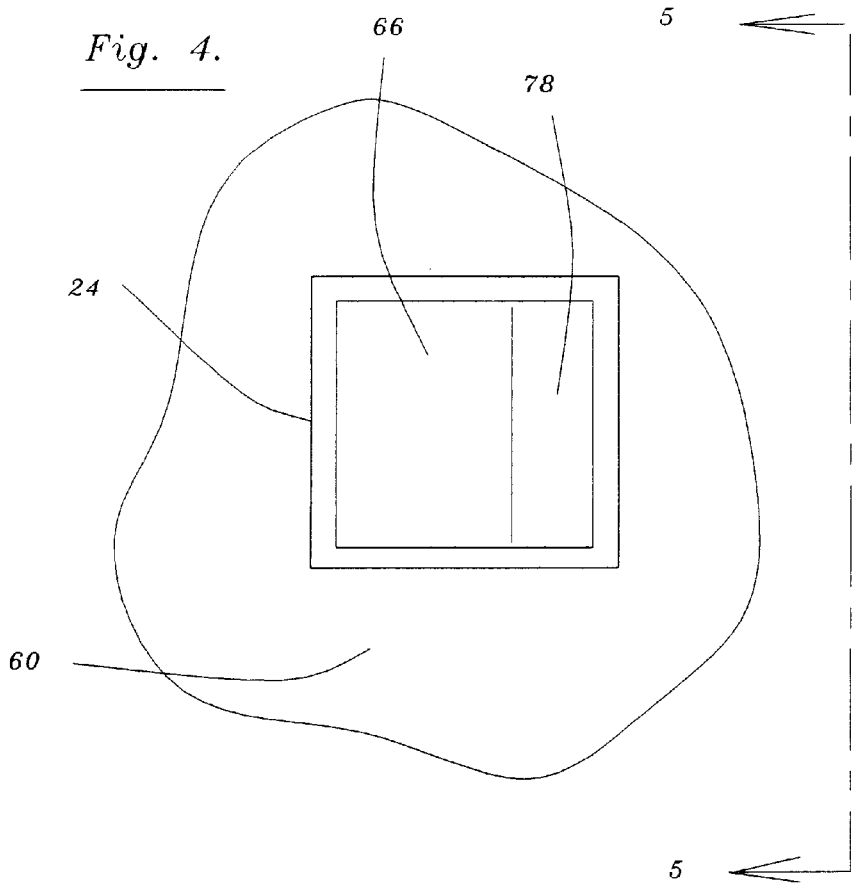
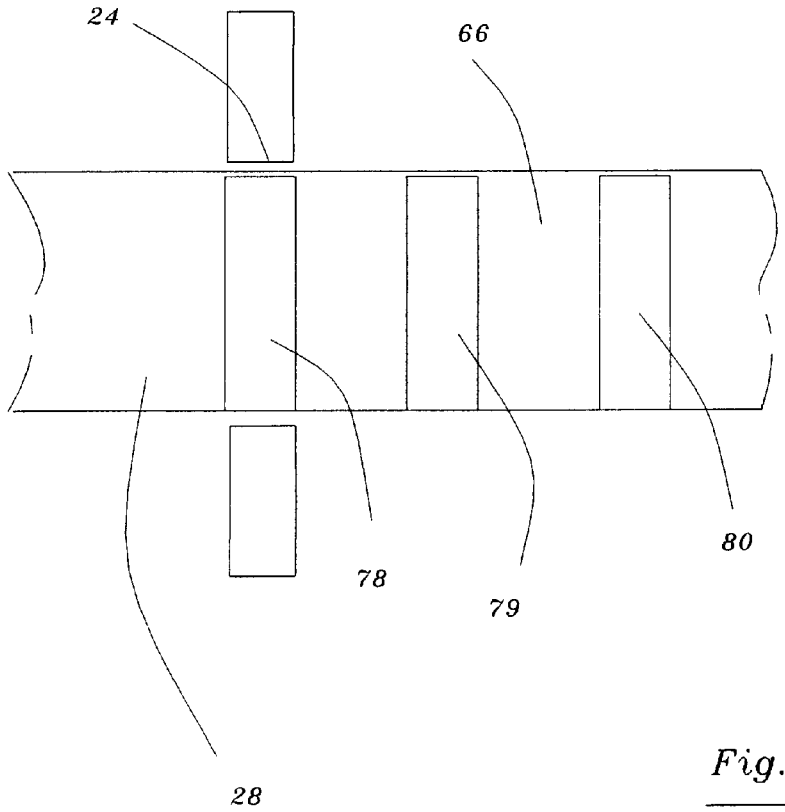
Fig. 5.

CLOTHES HANGER DEVICE

BACKGROUND OF THE INVENTION

1. Field of the Invention

The present invention relates to a clothes hanger device for hanging clothes from a support rail. More specifically, the present invention relates to an extending clothes hanger device for hanging clothes from a support rail.

2. Information Disclosure Statement

Clothes hangers typically include a hook and a depending hanger arrangement for supporting clothing within a clothes closet. However, clothes come in many sizes and shapes and much time is taken in fitting the clothing onto such hangers only to find such clothing later having slipped off the hanger because the hanger was too small to support the article of clothing.

The present invention overcomes the aforementioned problem of the prior art hangers by the provision of an adjustable hanger device that is extendible to accommodate various sizes of garments to be hung.

Therefore, it is a primary feature of the present invention to provide a hanger device that overcomes the aforementioned problems associated with the prior art arrangements and which makes a significant contribution to the art of hanging clothes.

Other objects and advantages of the present invention will be readily apparent to those skilled in the art by a consideration of the detailed description contained hereinafter taken in conjunction with the annexed drawings which show a preferred embodiment of the present invention.

SUMMARY OF THE INVENTION

The present invention relates to a clothes hanger device for hanging clothes from a support rail. The device includes a hook having a base, the hook removably cooperating with the support rail for supporting the device from the support rail. A frame is suspended from the base of the hook, the frame having a first and a second end. The first end of the frame defines a first hole and the second end of the frame defines a second hole. The arrangement is such that the base of the hook rotatably extends through the frame between the ends thereof. A first arm has a first and a second extremity, the first arm slidingly extending through the first and second holes. The second extremity defines a stop for limiting travel of the first arm relative to the frame. A biasing device is anchored to the first arm for biasing the first arm through the first and second holes. A second arm has a first and a second side, the second arm slidingly extending through third and fourth holes defined by the frame. The first side defines a further stop for limiting travel of the second arm relative to the frame. A further biasing device is anchored to the second arm for biasing the second arm through the third and fourth holes so that the arms are biased away from the frame. The arrangement is such that the first extremity of the first arm and the second side of the second arm engage the clothes for hanging the clothes relative to the support rail.

In a more specific embodiment of the present invention, the hook includes a curved portion for engaging the support rail.

Also, the frame includes a longitudinal portion having a first and a second edge and a first extension extending from the first edge of the longitudinal portion, the first extension defining the first and third holes. A second extension extends from the second edge of the longitudinal portion, the second extension defining the second and fourth holes.

Additionally, the longitudinal portion is suspended from the base of the hook midway between the edges thereof.

Furthermore, the first arm includes a first portion which extends from a stop to a first location. A second portion extends angularly from the first location of the first portion to the first extremity.

The second arm includes a first limb which extends from a further stop to a second location and a second limb extends angularly from the second location of the first limb to the second side of the second arm.

Also, the first arm further includes a first sleeve which encloses the second portion. The second arm further includes a second sleeve which encloses the second limb.

The first portion is of square transverse cross sectional configuration and the first portion defines a plurality of axially spaced transverse notches. The notches cooperate with the first hole such that when the first portion is rotated relative to the first hole, the first portion is selectively locked axially due to an interaction of at least one of the notches with the first hole.

Furthermore, the first limb is of square transverse cross sectional configuration and the first limb defines a further plurality of axially spaced transverse notches. The further notches cooperate with the fourth hole such that when the first limb is rotated relative to the fourth hole, the first limb is selectively locked axially due to an interaction of at least one of the further notches with the fourth hole.

BRIEF DESCRIPTION OF THE DRAWINGS

FIG. 4 is an enlarged view taken on the line 4—4 of FIG. 1;

FIG. 5 is a view taken on the line 5—5 of FIG. 4;

Similar reference characters refer to similar parts throughout the various embodiments of the drawings.

DETAILED DESCRIPTION OF THE DRAWINGS

Figure 1:
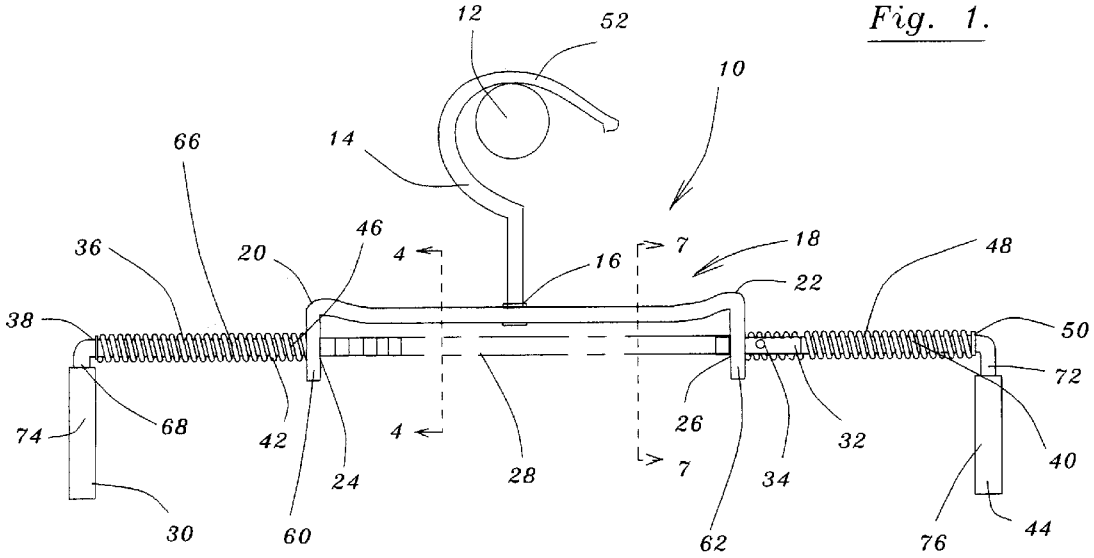
FIG. 1 is a side elevational view of a clothes hanger device according to the present invention.

FIG. 1 is a side elevational view of a clothes hanger device generally designated 10 according to the present invention. A shown in FIG. 1, the clothes hanger device 10 is used for hanging clothes from a support rail 12. The device 10 includes a hook 14 having a base 16, the hook 14 removably cooperating with the support rail 12 for supporting the device 10 from the support rail 12. A frame generally designated 18 is suspended from the base 16 of the hook 14, the frame 18 having a first and a second end 20 and 22 respectively. The first end 20 of the frame 18 defines a first hole 24 and the second end 22 of the frame 18 defines a second hole 26. The arrangement is such that the base 16 of the hook 14 rotatably extends through the frame 18 between the ends 20 and 22 thereof. A first arm generally designated 28 has a first and a second extremity 30 and 32 respectively, the first arm 28 slidingly extending through the holes 24 and 26 respectively. The second extremity 32 defines a stop 34 for limiting travel of the first arm 28 relative to the frame 18. A biasing device 36 is anchored to the first arm 28 at a first location 38 which is disposed between the first extremity 30 of the first arm 28 and the first hole 24. The biasing device 36 extends from the first location 38 to the hole 24 for biasing the first arm 28 through the holes 24 and 26 respectively. A second arm 40 has a first and a second side 42 and 44 respectively, the second arm 40 slidingly extending through a third hole 41 and a fourth hole 43 respectively. The first side 42 defines a further stop 46 for limiting travel of the second arm 40 relative to the frame 18. A further biasing device 48 is anchored to the second arm 40 at a second location 50 disposed between the second side 44 of the second arm 40 and the fourth hole 43. The further biasing device 48 extends from the second location 50 to the fourth hole 43 for biasing the second arm 40 through the holes 41 and 43 respectively so that the arms 28 and 40 are biased away from the frame 18. The arrangement is such that the first extremity 30 of the first arm 28 and the second side 44 of the second arm 40 engage the clothes for hanging the clothes relative to the support rail 12. As shown in FIG. 1, the hook 14 includes a curved portion 52 for engaging the support rail 12.

Figure 2:
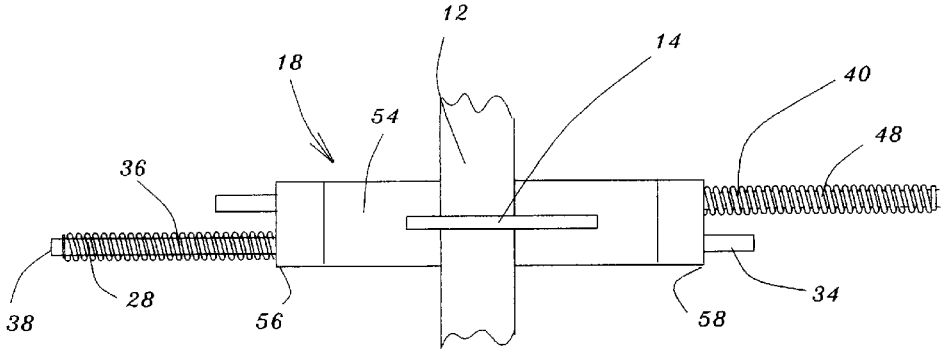
FIG. 2 is a top plan view of the device shown in FIG. 1.

FIG. 2 is a top plan view of the device 10 shown in FIG. 1. As shown in FIG. 2, the frame 18 includes a longitudinal portion 54 having a first and a second edge 56 and 58 respectively.

Figure 3:
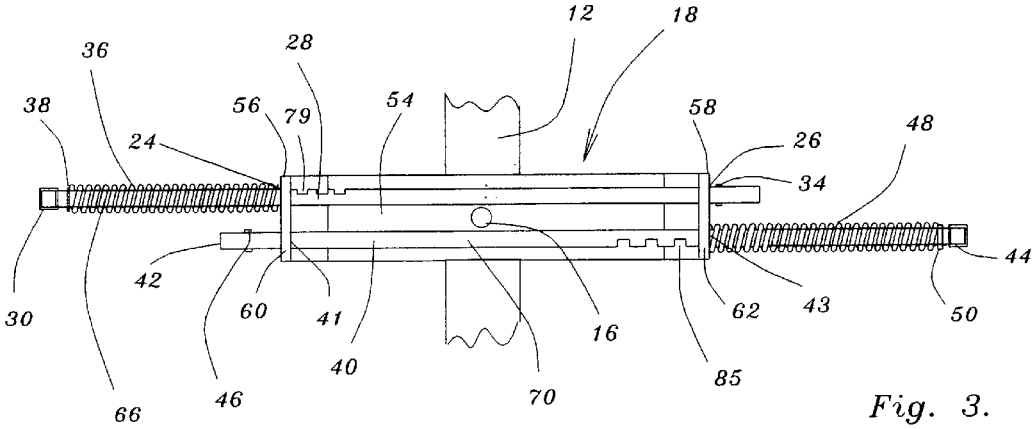
FIG. 3 is a bottom plan view of the device shown in FIG. 1.

FIG. 3 is a bottom view of the device 10 shown in FIG. 1. As shown in FIG. 3, a first extension 60 extends from the first edge 56 of the longitudinal portion 54, the first extension 60 defining the holes 24 and 41. A second extension 62 extends from the second edge 58 of the longitudinal portion 54, the second extension 62 defining the holes 26 and 43.

Additionally, the longitudinal portion 54 is suspended from the base 16 of the hook 14 midway between the edges 56 and 58 thereof.

Furthermore, the first arm 28 includes a first portion 66 which extends from the stop 34 to the first location 38. A second portion 68 extends angularly from the first location 38 of the first portion 66 to the first extremity 30 as shown in FIG. 1.

The second arm 40 includes a first limb 70 which extends from the further stop 46 to the second location 50 and a second limb 72 extends angularly from the second location 50 of the first limb 70 to the second side 44 of the second arm 40 as shown in FIG. 3.

Also, the first arm 28 further includes a first sleeve 74 which encloses the second portion 68. The second arm 40 further includes a second sleeve 76 which encloses the second limb 72 as shown in FIG. 1.

FIG. 4 is an enlarged view taken on the line 4—4 of FIG. 1. As shown in FIG. 4, the first portion 66 is of square transverse cross sectional configuration.

Figure 6:
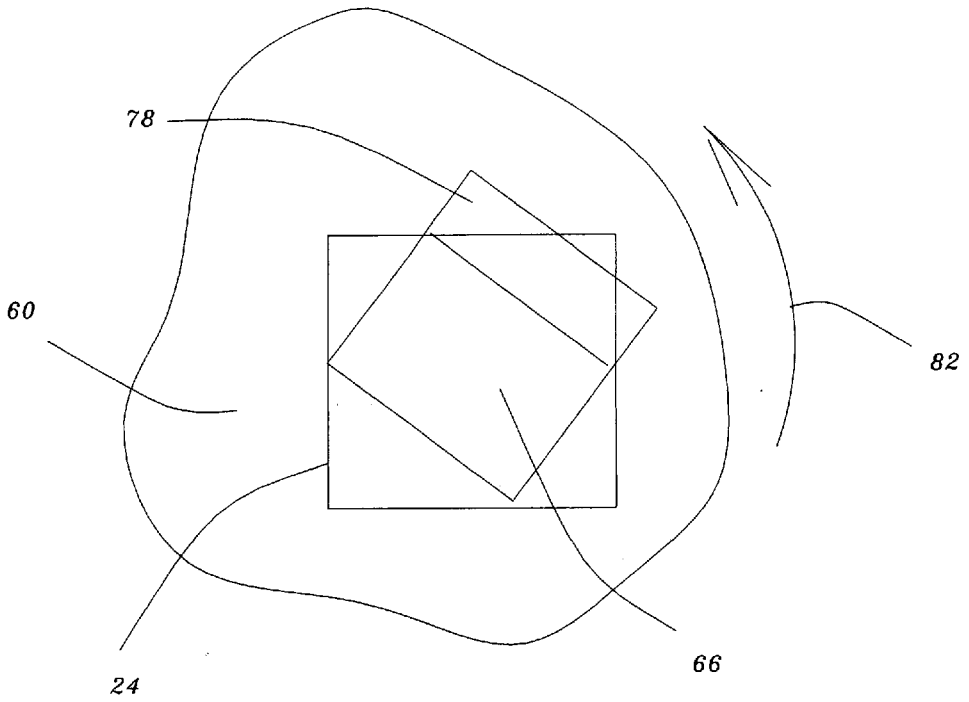
FIG. 6 is a similar view to that shown in FIG. 4 but with the arm rotated and locked in an extended disposition thereof.

FIG. 5 is a view taken on the line 5—5 of FIG. 4. As shown in FIG. 5, the first portion 66 defines a plurality of axially spaced transverse notches 78, 79 and 80. The notches 78–80 cooperate with the hole 24 such that when the first portion 66 is rotated as indicated by the arrow 82, relative to the hole 24, as shown in FIG. 6, the first portion 66 is selectively locked axially due to an interaction of at least one of the notches with the hole 24.

Figure 7:
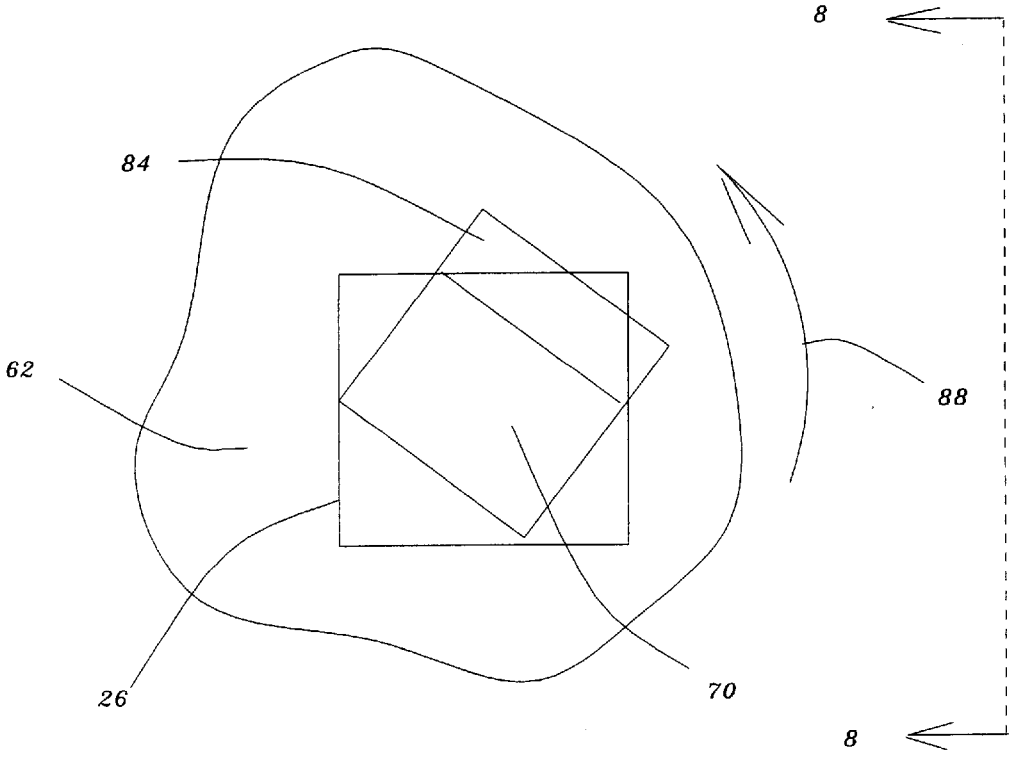
FIG. 7 is an enlarged view taken on the line 7—7 of FIG. 1.

FIG. 7 is an enlarged view taken on the line 7—7 of FIG. 1. As shown in FIG. 7, the first limb is of square transverse cross sectional configuration.

Figure 8:
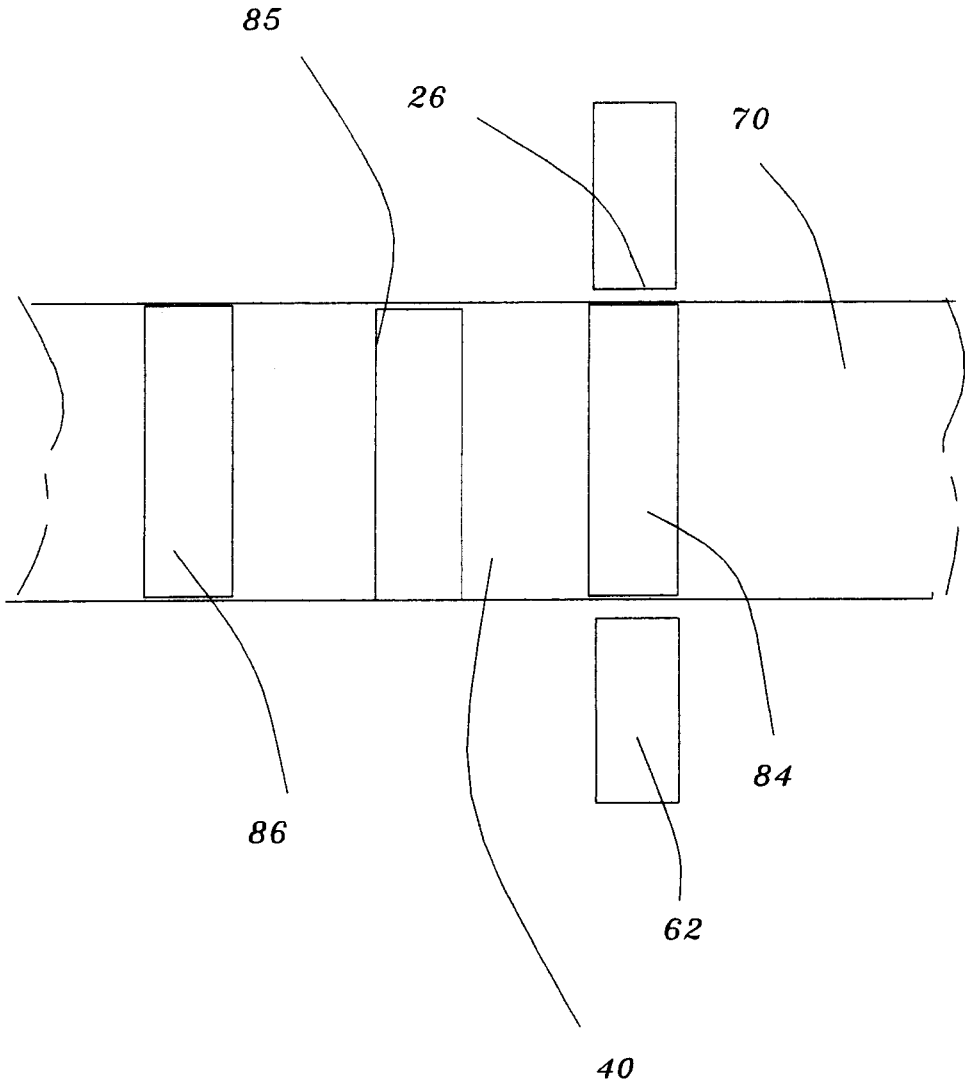
FIG. 8 is a view taken on the line 8—8 of FIG. 7.

FIG. 8 is a view taken on the line 8—8 of FIG. 7. As shown in FIG. 8, the first limb defines a further plurality of axially spaced transverse notches 84, 85 an 86. The further notches 84–86 cooperate with the hole 43 such that when the first limb 70 is rotated relative to the hole 43, as indicated by the arrow 88 shown in FIG. 7, the first limb 70 is selectively locked axially due to an interaction of at least one of the further notches 84–86 with the hole 43.

Figure 9:
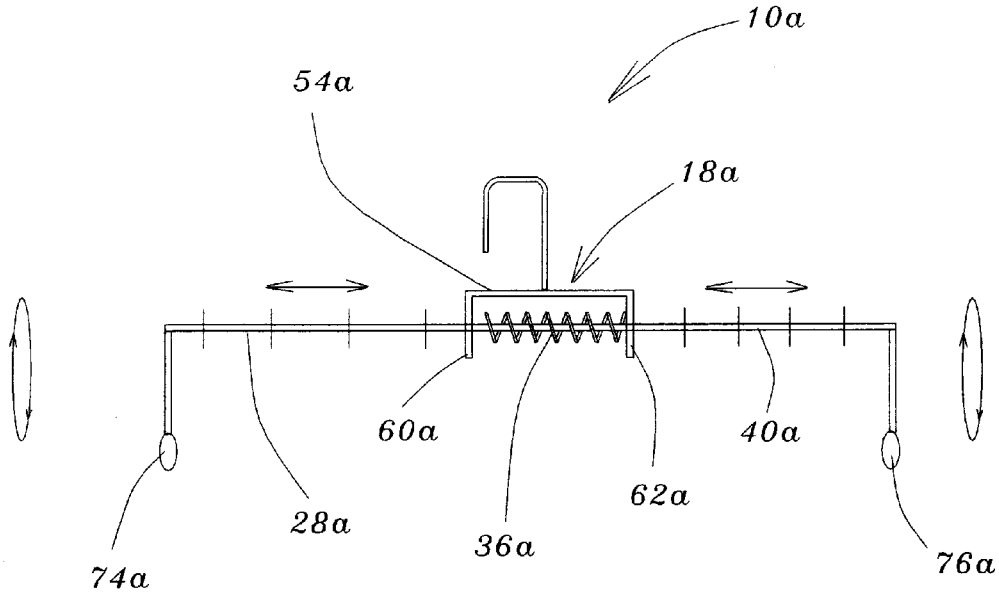
FIG. 9 is a side elevational view of an alternative embodiment of the present invention.

FIG. 9 is a side elevational view of an alternative embodiment of the present invention. As shown in FIG. 9, the clothes hanging device 10*a* includes a biasing means 36*a* and further biasing means 48*a* disposed within the frame 18*a* such that the biasing means 36*a* and further biasing means 48*a* constitute compression springs for urging the respective arms 28*a* and 40*a* inwardly towards the frame 18*a*.

Figure 10:
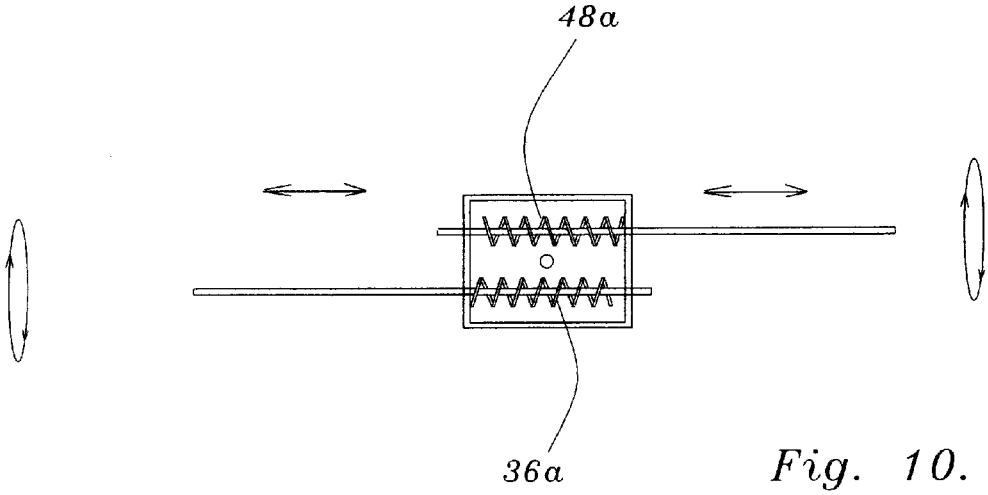
FIG. 10 is a top plan view of the device shown in FIG. 9.

FIG. 10 is a top plan view of the device 10*a* shown in FIG. 9. As shown in FIGS. 9 and 10, the banging device utilizes a rod of metal formed to accommodate clothing and other types of material so that such clothing may be suspended above the floor for a period of time for drying and storage while using a minimal amount of space. The hanger device is also used as an extension support unit in accommodating such materials that a person does not want to wrinkle or disfigure but which uses only a limited space.

The hanger is made from 8 gauge square wire. The plastic end protectors 74*a* and 76*a* are made of HEDP plastic of 12 gauge (polyurethane, plastic mix). The bridge plate or frame 18*a* is made from 8 gauge flat stock with the dimensions of ⅛th inch thick, ½ inch wide and 3 inches long with the extensions 60*a* and 62*a* being 1 inch each in length. The extensions are disposed at an angle of 90 degrees relative to the longitudinal portion 54*a*. The hook is of 8 gauge square wire and the biasing means are made from 14 gauge wire which is spring rolled and tightened.

The left and right arms 28*a* and 40*a* not only recoil in and out of the frame 18*a* with the springs 36*a* and 48*a*, but also rotate and lock themselves into place with notches or slots that are cut into the arms 28*a* and 40*a* for better adjustment to the materials that are being hung.

The present invention provides a unique clothes hanger device that is easy to use and which accommodates various sizes and types of clothing.

What is claimed is:

1. A clothes hanger device for hanging clothes from a support rail, said device comprising:

a hook having a base, said hook removably cooperating with the support rail for supporting said device from the support rail;

a frame suspended from said base of said hook, said frame having a first and a second end, said first end of said frame defining a first hole, said second end of said frame defining a second hole, the arrangement being such that said base of said hook rotatably extends through said frame between said ends thereof, said first end of said frame also defining a third hole and said second end of said frame defining a fourth hole;

a first arm having a first and a second extremity, said first arm slidingly extending through said first and second holes, said second extremity defining a stop for limiting travel of said first arm relative to said frame;

a biasing device anchored to said first arm for biasing said first arm through said first and second holes;

a second arm having a first and a second side, said second arm slidingly extending through said third and fourth holes, said first side defining a further stop for limiting travel of said second arm relative to said frame; and a further biasing device anchored to said second arm for biasing said second arm through said third and fourth holes so that said arms are biased relative to said frame such that said first extremity of said first arm and said second side of said second arm engage the clothes for hanging the clothes relative to the support rail.

2. A clothes hanger device as set forth in claim 1 wherein said hook includes:

a curved portion for engaging the support rail.

3. A clothes hanger device as set forth in claim 1 wherein said frame includes:

a longitudinal portion having a first and a second edge;

a first extension extending from said first edge of said longitudinal portion, said first extension defining said first and third holes;

a second extension extending from said second edge of said longitudinal portion, said second extension defining said second and fourth holes.

4. A clothes hanger device as set forth in claim 3 wherein said longitudinal portion is suspended from said base of said hook midway between said edges thereof.

5. A clothes hanger device as set forth in claim 1 wherein said biasing device is disposed at a first location disposed between said first extremity of said first arm and said first hole;

said further biasing device is disposed at a second location disposed between said second side of said second arm and said fourth hole.

6. A clothes hanger device as set forth in claim 1 wherein said biasing device and said further biasing device are disposed within said frame.

7. A clothes hanger device as set forth in claim 1 wherein said first arm includes:

a first portion which extends from said stop to a first location;

a second portion extending angularly from said first location of said first portion to said first extremity;

said second arm includes:

a first limb which extends from said further stop to a second location;

a second limb extending angularly from said second location of said first limb to said second side of said second arm.

8. A clothes hanger device as set forth in claim 7 wherein said first arm further includes:

a first sleeve which encloses said second portion;

said second arm further includes:

a second sleeve which encloses said second limb.

9. A clothes hanger device as set forth in claim 7 wherein said first portion is of square transverse cross sectional configuration, said first portion defining a plurality of axially spaced transverse notches, said notches cooperating with said first hole such that when said first portion is rotated relative to said first hole, said first portion is selectively locked axially due to an interaction of at least one of said notches with said first hole;

said first limb is of square transverse cross sectional configuration, said first limb defining a further plurality of axially spaced transverse notches, said further notches cooperating with said fourth hole such that when said first limb is rotated relative to said fourth hole, said first limb is selectively locked axially due to an interaction of at least one of said further notches with said fourth hole.

* * * * *